US005222818A

United States Patent [19]

Akiyama et al.

[11] Patent Number: 5,222,818

[45] Date of Patent: Jun. 29, 1993

[54] TAPE PRINTER APPARATUS AND CONTROL METHOD

[75] Inventors: Takaaki Akiyama; Eizo Takahashi; Naohiko Koakutsu, all of Suwa, Japan

[73] Assignee: Seiko Epson Corporation, Tokyo, Japan

[21] Appl. No.: 752,128

[22] Filed: Aug. 29, 1991

[30] Foreign Application Priority Data

| | | | |
|---|---|---|---|
| Aug. 29, 1990 | [JP] | Japan | 2-227703 |
| Aug. 29, 1990 | [JP] | Japan | 2-227704 |
| Aug. 29, 1990 | [JP] | Japan | 2-227705 |
| Jun. 27, 1991 | [JP] | Japan | 3-156423 |

[51] Int. Cl.[5] ..... B41J 5/30

[52] U.S. Cl. ..... 400/61; 400/76; 400/120; 400/621; 101/233; 346/76 PH; 346/24; 226/143

[58] Field of Search ..... 400/621, 322, 76, 120, 400/61, 64; 101/91, 233; 226/143; 318/561; 346/24, 76 PH

[56] References Cited

U.S. PATENT DOCUMENTS

| | | | |
|---|---|---|---|
| 4,462,708 | 7/1984 | Luartes et al. | 400/63 |
| 4,560,990 | 12/1985 | Sue et al. | 400/621 |
| 4,568,950 | 2/1986 | Ross et al. | 400/120 |
| 4,646,635 | 3/1987 | Salazar et al. | 101/91 |
| 4,836,697 | 6/1989 | Plotnick et al. | 400/120 |
| 4,925,325 | 5/1990 | Niikawa | 400/621 |
| 4,926,191 | 5/1990 | Takenaka et al. | 346/24 |
| 5,062,722 | 11/1991 | Shiozaki et al. | 400/621 |

FOREIGN PATENT DOCUMENTS

| | | | |
|---|---|---|---|
| 0191495 | 8/1986 | European Pat. Off. | 400/621 |
| 0091687 | 7/1980 | Japan | 400/621 |
| 0090971 | 5/1983 | Japan | 400/621 |
| 0013580 | 1/1985 | Japan | 400/621 |
| 0162675 | 8/1985 | Japan | 400/621 |
| 0152469 | 7/1986 | Japan | 400/621 |
| 62-044472 | 2/1987 | Japan . | |
| 63-62754 | 3/1988 | Japan . | |
| 2-169278 | 6/1990 | Japan . | |

*Primary Examiner*—Eugene H. Eickholt
*Attorney, Agent, or Firm*—Raymond J. Werner

[57] ABSTRACT

A printer that prints characters or graphics on tape by means of a thermal print head, having a cutting means that cuts the tape at predetermined positions, and control means which act to eliminate printing defects such as gaps, or spaces, between printed dot strings. Gaps between printed dot strings, caused by a tape cutting operation that pulls the tape past the print head, is eliminated by the control means which reverses the tape feed mechanism in order to slacken the tape just prior to cutting. After cutting, the control means forwards the tape by an amount less than or equal to the amount reversed and printing is resumed. Printer also provides means for entry of lead margin length, total tape length, character spacing and character string to be printed by means of a keyboard. Rear Margin length is computed by the printer.

23 Claims, 18 Drawing Sheets

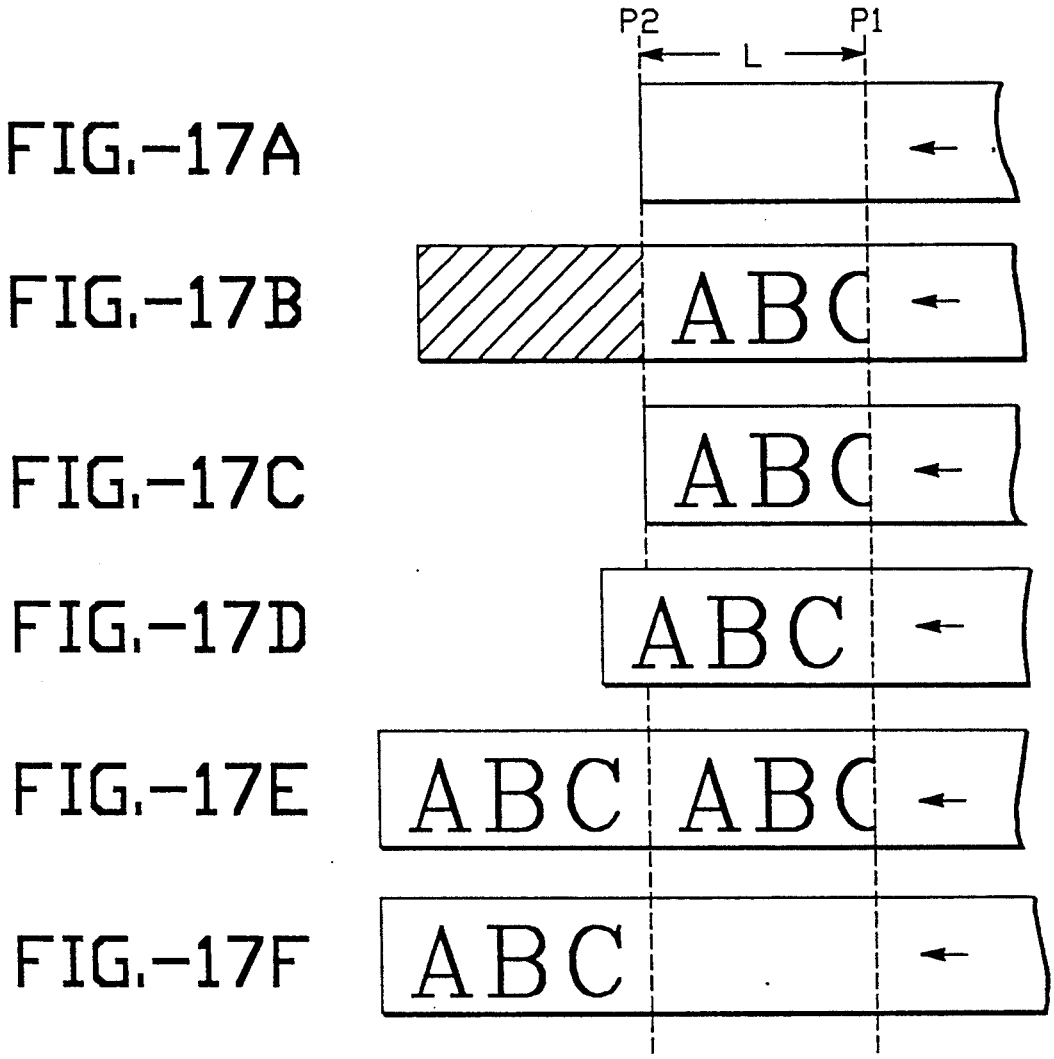
P2
P1
L
FIG.-17A
FIG.-17B
ABC
FIG.-17C
ABC
FIG.-17D
ABC
FIG.-17E
ABC ABC
FIG.-17F
ABC
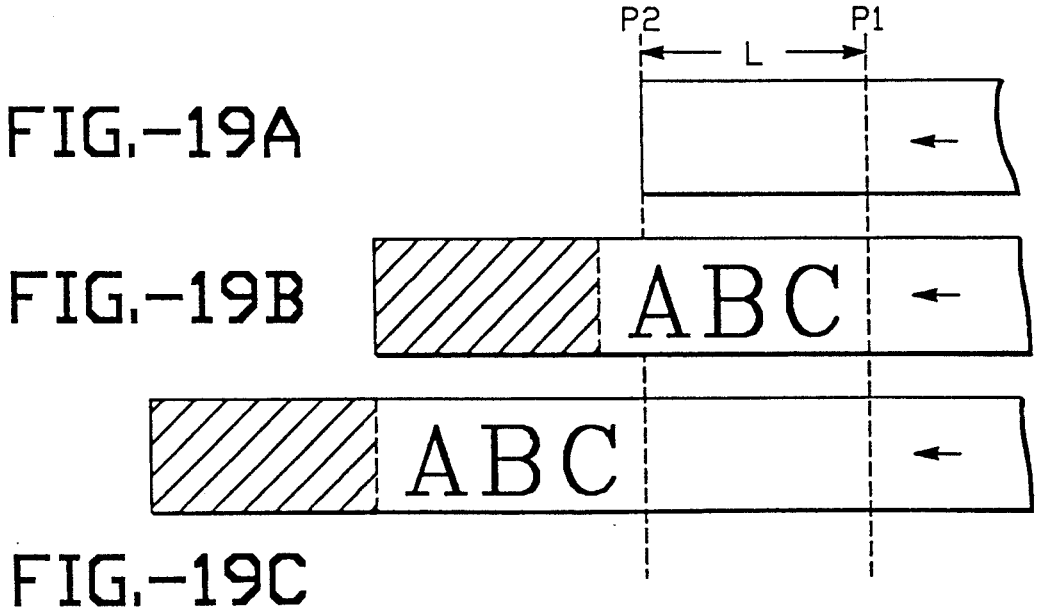
P2
P1
L
FIG.-19A
FIG.-19B
ABC
ABC
FIG.-19C

TAPE PRINTER APPARATUS AND CONTROL METHOD

BACKGROUND OF THE INVENTION

The present invention relates to printers that print characters or graphics on tape type print media, and more particularly relates to a tape printer apparatus and control method for controlling a tape cutting means within a tape printer having a tape cutting means.

Two significant problems exist with prior art tape printers as is explained in detail below. The first problem is related to print quality. Gaps are created between the dot strings which comprise a graphic or character symbol when, in a prior art tape printer, during the printing of a symbol, tape feeding is suspended and the tape is cut. Prior cutting means pulled the tape slightly through the print means so that when printing resumed, a larger than acceptable space between dot strings existed. These gaps give rise to undesirably noticeably intrasymbol gaps. The second problem is related to wasted tape. Tape waste arises from the need to advance the tape by an amount large enough to move the printed portion of the tape beyond the cutting means. Because of this tape transfer, the next printed tape will have an excess and unwanted lead portion.

In prior art tape printers blank space, approximately equal to the distance separation the printing means from the cutting means, preceded the printed portion of the tape being printed in order for the printing means and cutting means to be positionally separated. The tape was fed, up to a predetermined position, by the tape feed means after which the tape was cut.

These types of printers have been disclosed in Japanese Patent Early Disclosure H2-147272 (U.S. Pat. No. 4,836,697) and Japanese Patent Early Disclosure S58-500475 (U.S. Pat. No. 4,462,708).

FIGS. 19(*a*)–(*c*) illustrate an example of the label making process of a prior art tape printer. In this example, production of a tape piece (i.e. label) printed with the character string "ABC" is shown. In FIGS. 19(*a*)-(*c*), P1 is the position of thermal print head 105, P2 the position of the cutting blade, and L is the head-to-cutter distance. FIG. 19(*a*) shows the state of the tape before printing takes place; printing starts in this state and tape feeding occurs during this printing operation. FIG. 19(*b*) shows the state where printing has been completed. Next, in this example, the tape is fed to the left a distance substantially equal to L in order to output the tape piece. FIG. 19(*c*) shows the state where the printed tape has reached tape cutting position P2. When cutting is done, the tape piece printed with "ABC" will be output.

It can be seen that the tape piece output has an excess portion substantially equal to length L in the portion which leads the printed portion (as shown by slanted lines in FIGS. 19(*b*)–(*c*)). This excess portion may have to be cut off by some method before using the tape piece as a label. This leads to wasted tape, and the user suffers the nuisance of having to cut off this excess with scissors or the like.

FIG. 20 is a flowchart illustrating the label making process of prior art tape printers. Initially printing is done on the tape (step 401), after which feeding (i.e. advancing or forwarding) of the printed tape is done (step 402) to a length substantially equal to L (i.e. the distance between the printing position and the tape cutting position). Tape cutting (step 403) is done, and the printed piece of tape is output. Next comes a decision (step 404) of whether to repeat the printing. When printing is to be repeated control returns to printing (step 401), and when no further printing is to be done, the process ends (step 405). After outputting the printed tape piece, the work of cutting off the excess portion included in the output tape piece must be done by the user.

This excess portion is generally useless, and resources could be saved and costs reduced if production of this excess portion of tape could be eliminated. In order to accomplish this, it would be good if there were no positional distance between the printing means and the cutting means, but this would lead to difficulties in the mechanism. Therefore a need exists for a way to decrease or eliminate the production of this useless tape.

FIG. 21 shows the distorted dots of the prior art tape printers, showing the print dots when printing is suspended during printing and cutting is done. After printing dot string 207, tape feed is suspended and tape cutting is done. The printed tape is pulled by the cutter in the tape feed direction during the cutting process. This means that the distance between the dots of print string 208 and print string 207 will be greater than the distance between the other dot strings, and because of this there is a gap, or space, between print strings. The difference between the distance d1 between dot strings of conventional printing 206, 207 and the distance d2 between dot strings before and after tape cutting 207, 208 is about 0.05 mm. A gap of this size, shown by arrow D in FIG. 21, can be clearly seen on a printed tape. Consequently, special control is necessary so that the tape cutting process can be done without adversely affecting the quality of subsequent print strings.

Further, although prior attempts have been made to cut recording paper in the course of printing, they lacked practicality because of problems related to the recording paper shifting during cutting and producing gaps in the resultant printing.

SUMMARY OF THE INVENTION

It is an object of tape printer and control method of the present invention to reduce the blank spaces between dot strings on the output tape pieces, which are attributable to tape slippage, or pulling.

It is an object of the present invention to minimize the amount of tape wasted due to feeding out a length of tape substantially equal to the distance between the printing means and the cutting means.

The tape printer of the present invention has a control means that reverses the tape feed roller by a predetermined amount just before cutting the tape in order to slacken the tape, a control means that controls tape cutting, a control means that directs the forwarding of tape by an amount equal to or less than the amount that was reversed, and a control means that directs the resumption of printing.

The present invention has a tape length setting means that sets the length of the tape, a lead margin setting means that sets the blank space for printing initiation, a rear margin computation means that sets the rear margin by computing the margin of the final end of printing from the length set by the tape length setting means and the lead margin setting means, and a cutting means that cuts the tape at a position determined in conjunction with the tape length setting means.

Savings in tape will be possible particularly when outputting printed tape continuously, because excess tape is produced only once at the very start, and no excess tape is made during printing after that.

An advantage of the tape printer apparatus and control method of the present invention is that unwanted gaps, spaces, in print strings are not generated by the tape cutting operation.

A further advantage of the present invention is that savings in tape will be possible particularly when continuously outputting printed tape, because excess tape is produced only once at the very start of the process.

A further advantage of the present invention is an easy-to-use tape printer that provides users the facility to select and enter the lead margin and the tape length values.

Other objects, attainments and advantages, together with a fuller understanding of the invention, will become apparent and appreciated by referring to the following description and claims taken in conjunction with the accompanying drawings.

BRIEF DESCRIPTION OF THE DRAWINGS

FIGS. 17(*a*)–(*f*) illustrate the relationship between the position of the cutting means, the position of the print head, and the printing of the tape.

FIGS. 19(*a*)–(*c*) show the tape label making process in a prior art tape printer.

DETAILED DESCRIPTION OF THE INVENTION

The present invention is now described with reference to the figures wherein like numerals indicate like elements throughout.

Structure of the Tape Printer

Figure 1:
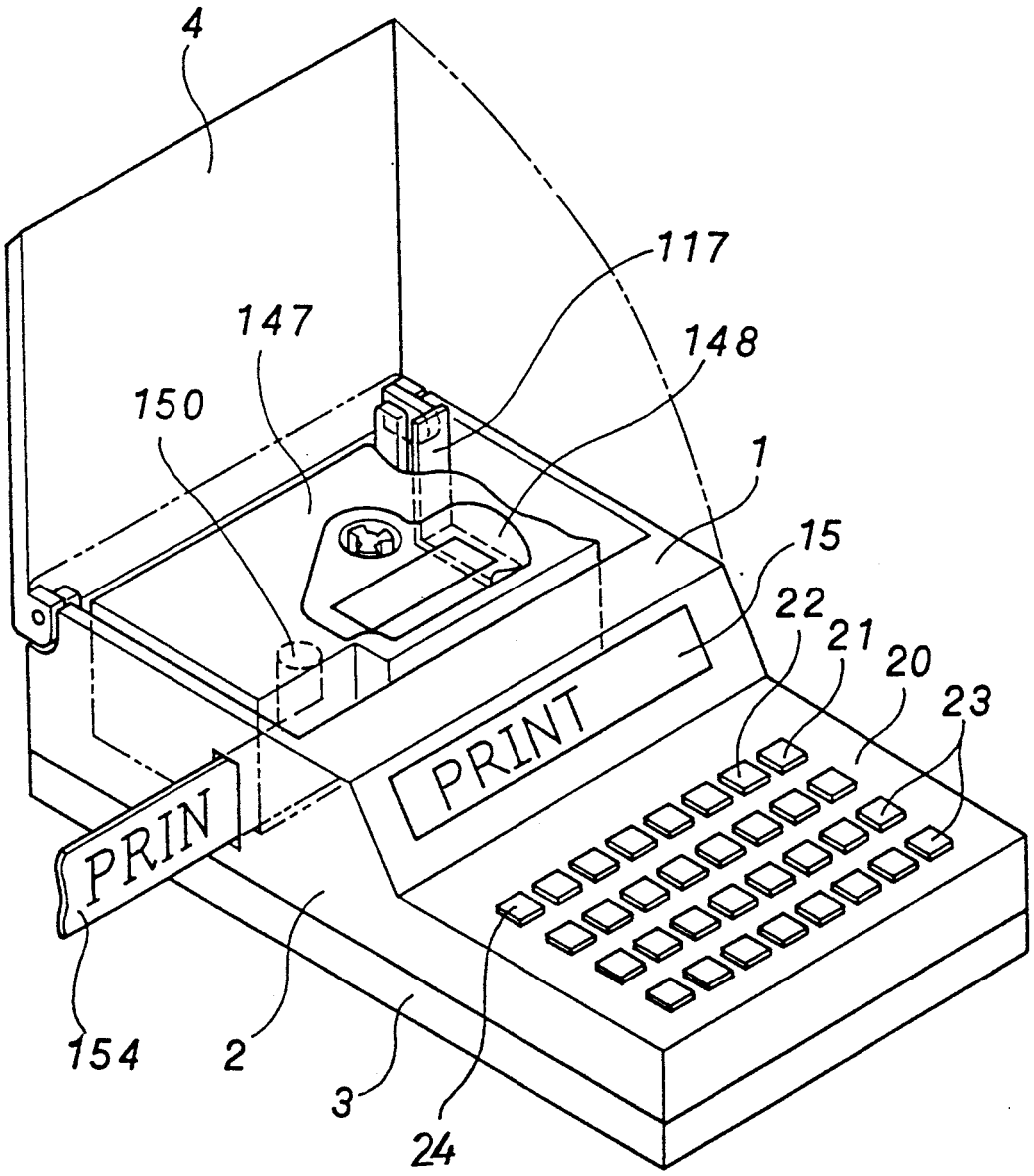
FIG. 1 shows the outside of a tape printer according to the present invention as it would appear to a user.

FIG. 1 is an outside view showing an example of the present invention. Printer unit 1 is encased with upper case 2, lower case 3, and cassette cover 4. FIG. 1 further shows that cassette cover 4 is open and tape cassette 147 and ribbon cassette 148 are mounted.

Display unit 15, preferably a liquid crystal display, and keyboard 20 with an array of keys such as power supply key 21, print key 22, character keys 23 and function keys 24, are elements of one embodiment of the present invention.

Figure 2A:
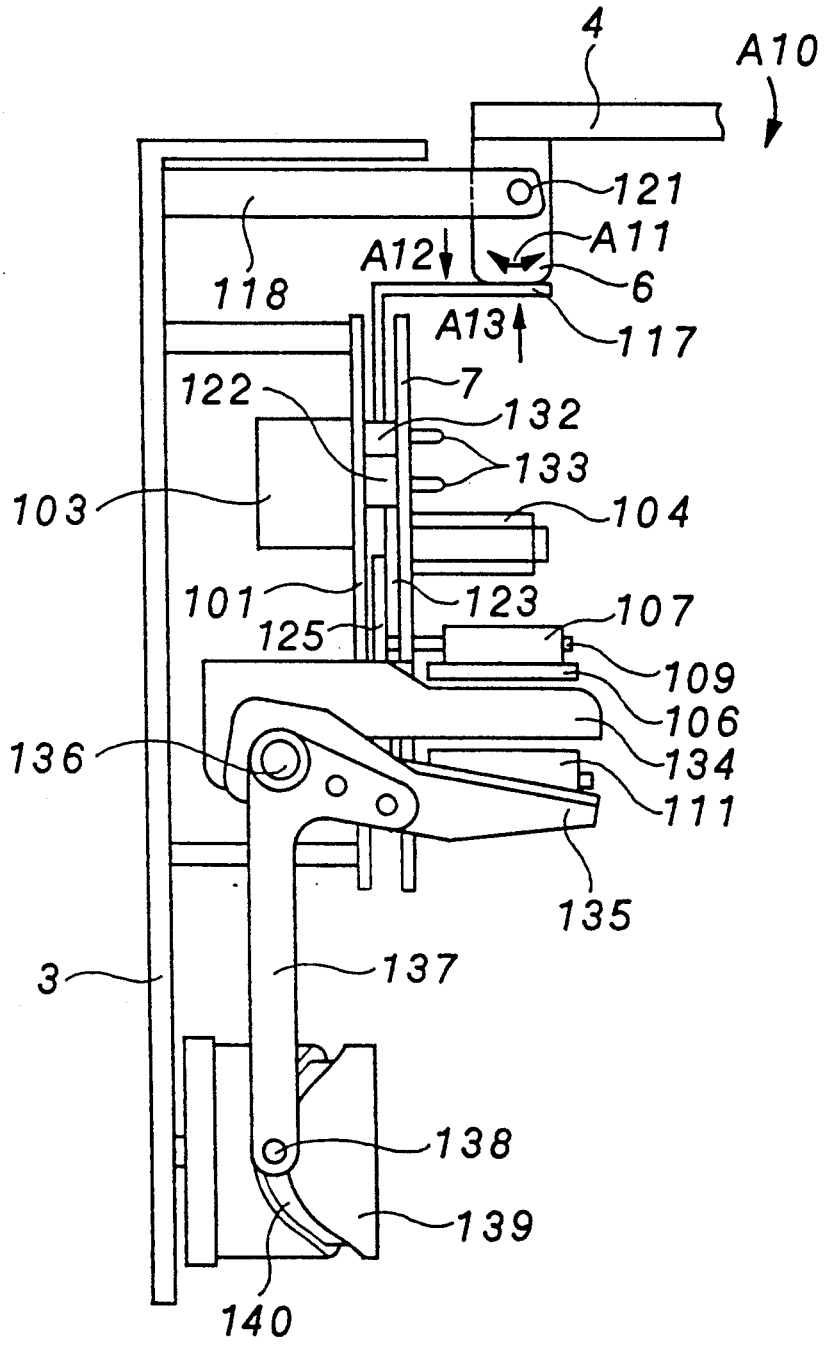
FIG. 2(*a*–(*b*) show portions of the mechanical structure of a tape printer according to the present invention.
Figure 2B:
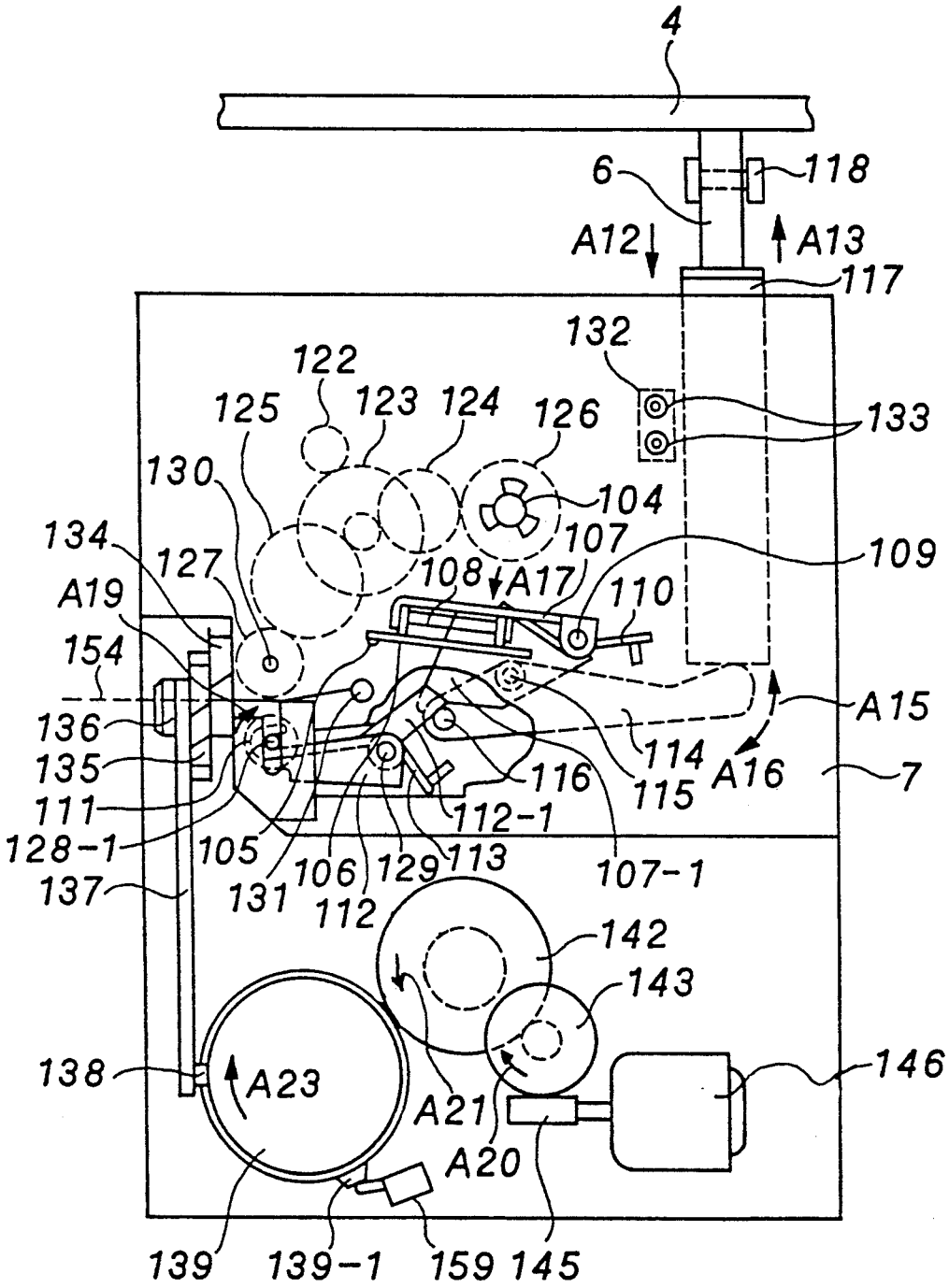

FIGS. 2(*a*) and (*b*) show the construction of the mechanism portion of the tape printer of the present invention. FIG. 2(*b*) is a top view showing the structure where there is no tape cassette loaded in the tape printer, and FIG. 2(*a*) is a left side view of FIG. 2(*b*). As will be understood from FIGS. 2(*a*) and (*b*), cassette cover 4 of the tape cassette mounting portion is open.

Thermal print head 105 has a plurality of heating elements (not shown) and is supported by support member 106. Head arm 107 has a direct contact portion 107-1 with release lever shaft 116 and is axially supported on head arm shaft 109. Head support shaft 108 has the function of supporting head support member 106 on head arm 107. Head compression spring 110 has the function of pushing head arm 107 in the direction of arrow A17. Tape feed roller 111 is attached to shaft portion 128-1 of tape feed gear 128 (shown in FIG. 4). Tape feed roller holder 112 has contact portion 112-1 that holds tape feed gear 128. Tape feed roller spring 113 has the function of pushing shaft portion 128-1 in the direction of arrow A19. Tape feed roller holder shaft 129 supports tape feed roller holder 112. A release lever 114 is axially supported on a release lever support shaft 115 which is attached to mainframe 101 and capable of rotation in the two directions of arrows A15 and A16. A release lever shaft 116 is attached to release lever 114. A release lever 117 is guided by subframe 7 and is in contact with release lever 114 and is capable of shifting in the two directions shown by arrows A12 and A13. Subframe 7 is made of plastic and is attached to mainframe 101.

Cassette cover 4 is capable of rotation in the direction of arrow A10 with release cam shaft 121 as a fulcrum and having a release cam capable of rotation in the direction of arrow A11 with the function of controlling the shifting of release lever 117. Printer lower case 3 is attached to mainframe 101. Support column 118 supports release cam shaft 121 formed integrally with lower case 3.

A motor 103 has a motor gear 122, which drives ribbon winding gear 126 by the rotation of motor gear 122 by engaging with transmission gear 124 from transmission gear 123. A ribbon winding shaft 104 is driven by ribbon winding gear 126. Tape feed transmission gear 127 receives the rotation of motor gear 122 via transmission gear 123 and transmission gear 125. The axis of feed transmission gear 127 is shown by reference numeral 130. Platen roller shaft 131 is also shown in FIG. 2(*b*).

A cassette detector 132 has a switch portion 133 that detects the presence or absence of the tape cassette and the type of tape cassette relative to a parameter such as tape width.

Figure 3:
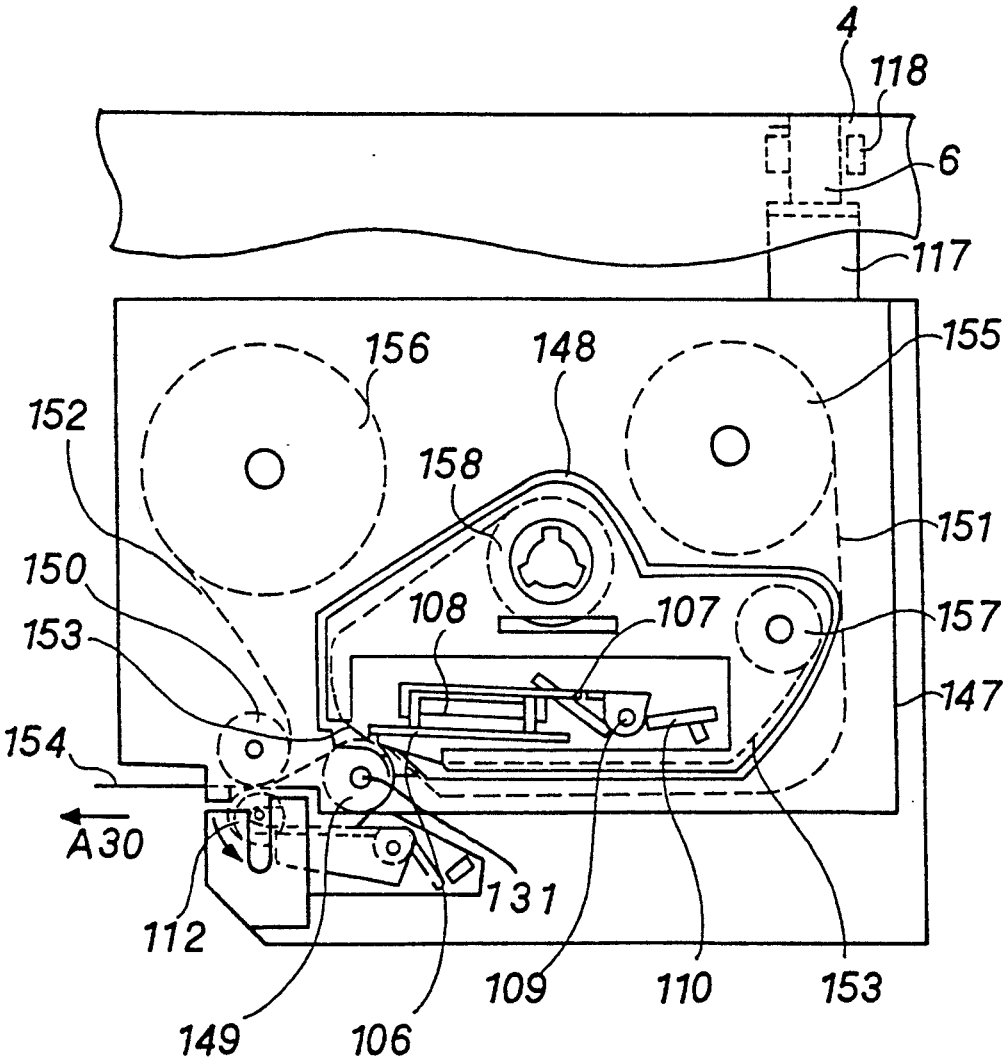
FIG. 3 is a top view showing a tape cassette mounted in a tape printer according to the present invention.

Cutter blades 134, 135 cut the tape. Worm gear 145 rotates by means of DC drive motor 146. Fixed blade 134 is attached to printer frame 101. Cutter drive gear 139 rotates via transmission gears 142, 143, Arrows A20, A21 and A23 show the rotational directions of the transmission gears. Cam curve channel 140 is formed in cutter drive gear 139, and cutter drive pin 138 attached to cutter arm 137 shifts up and down in this channel. Accordingly cutter drive pin 138 rotates with cutter rotation shaft 136 as the center by means of the rotation of cutter drive gear 139. Cutter blade 135 attached to cutter arm 137 rotates because of this rotational movement, and cuts printing tape 154 fed out by tape compression roller 150, and tape feed roller 111, as shown in FIG. 3. Cutter home detector 159 comprises a microswitch that detects the cutter home position by means of projection 139-1 on cutter drive gear 139.

FIG. 2(*b*) shows that release lever 117 is pressed in the direction of the two arrows A12 and A16 by release cam 6. Consequently at release cam 6 a counter force is received in the direction of the two arrows A13 and A15 by the force of head compression spring 110 and tape feed roller spring 113, and rotation in the direction of the two arrows A16 and A15 is stopped.

FIG. 3 is a diagram of tape cassette 147 and ribbon cassette 148 mounted in the tape printer mechanism portion of the present invention. Tape cassette 147 is mounted so as to cover the side surface portion of ribbon cassette 148. Inside tape cassette 147 are mounted transparent tape 151 to be printed and double sided adhesive tape 152 for protecting its printed surface. FIG. 3 shows the state where cassette cover 4 is closed, head support member 106 on the printer unit is pressed against platen roller 149 on tape cassette 148 and tape feed roller 112 on the printer unit is pressed against tape compression roller 150 on the tape cassette. Transparent tape 151 and ink ribbon 153 are held under pressure by head support member 106 and platen roller 149 while double sided adhesive tape 152 and transparent tape 151 are held under pressure by tape feed roller 112 and tape compression roller 150.

Figure 4:
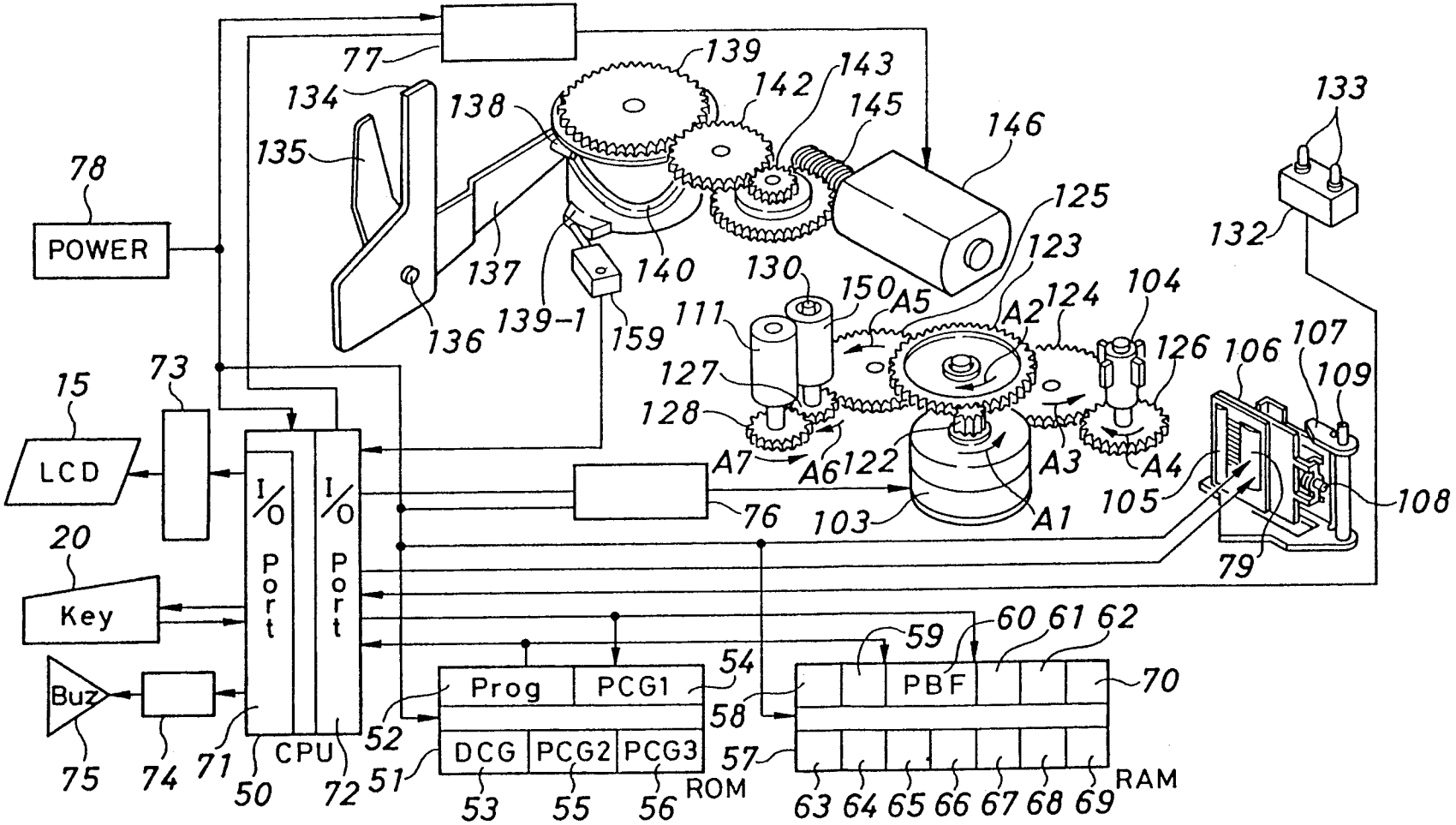
FIG. 4 is a block diagram showing the overall construction of a tape printer according to the present invention.

FIG. 4 is a block diagram of a tape printer of the present invention.

Tape printer input and output devices are controlled generally by CPU 50. CPU 50 is a programmed data processor, and more particularly, in he preferred embodiment is an MN18801A microprocessor, manufactured by Matsushita, with external program memory. CPU 50 has ports 71, 72 for numerous I/O that perform input and output control. Liquid crystal display apparatus 15 is controlled via LCD drive 73. Direct key scanning of keyboard 20 is done by CPU 50 to detect which key has been input. Buzzer 75 gives alarms and responses, which are controlled by CPU 50 by means of buzzer drive 74. ROM 51, program 52, character generator (hereafter called CG) 53 used for display, and CG 54, 55 and 56 used for printing are installed internally. By having plural CGs for printing, it is possible to print with a plurality of character fonts and styles.

The use enters information regarding which of a predetermined plurality of character fonts is to be used and which of a plurality of printing styles such as italic, bold, outline, and so on, are to be used. The control means of the printer use this stored information to select appropriate sections of character generator memory from which to create the bit-mapped representations of input data.

RAM 57 provides memory for such functions as editing buffer 58, display buffer 59, printing buffer 60, work area 61, stack area 62, character height setting 63 for the print setting, character width setting 64, character ornamentation setting 65, character space setting 66, tape length setting 67, lead margin setting 68, font selection 69 and repeat setting 70.

A stepper motor drive 76 does tape feeding and drives stepper motor 103. DC motor drive 77 performs cutter driving and drives DC motor 146. Thermal print head 105, that is one type of printing head, is driven by head drive 79. Thermal print head 105 is supported by head support member 106 and by head arm 107, head support shaft 108 and head arm shaft 109. A tape cassette detector 132 detects whether there is a tape cassette and also detects which of a plurality of tape widths is present by means of two switch parts 133. When stepper motor 103 is driven in the forward direction, motor gear 122 rotates in the direction of arrow A1 and transmission gear 123 rotates in the direction of A2. Tape feed transmission gear 127 is driven in the A6 direction from transmission gear 123 via transmission gear 125, and tape feed gear 128 also rotates so that tape feed roller 111 feeds out tape. Tape compression roller 150 is mounted on the side of the tape cassette, and while tape cassette 147 is mounted, holds printing tape 154 pressed against tape feed roller 111. A tape feed transmission gear shaft 130 also serves as a support shaft for tape compression roller 150. Transmission gear 123 also rotates transmission gear 124, as well as ribbon winding gear 126. From the rotation of ribbon winding gear 126, ribbon winding shaft 104 rotates in the direction of arrow A4 and winds ribbon 153 around ribbon winding core 158. Arrows A3, A5 and A7 show the rotational direction of the gears that perform tape feeding. A power source 78 drives all of the above-identified circuits.

Printing Control

Figure 5A:
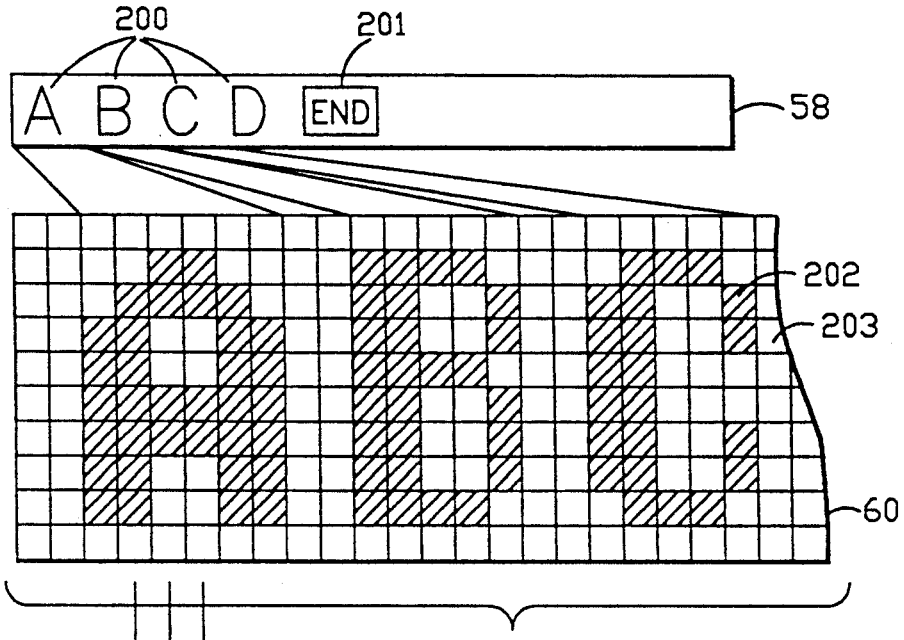
FIGS. 5(*a*)–(*b*) show character code, bit-mapped, and printed representations of data that has been input to the printer of the present invention
Figure 5B:
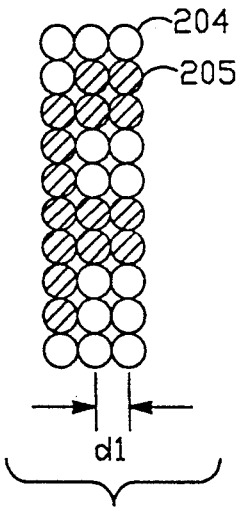
Figure 21:
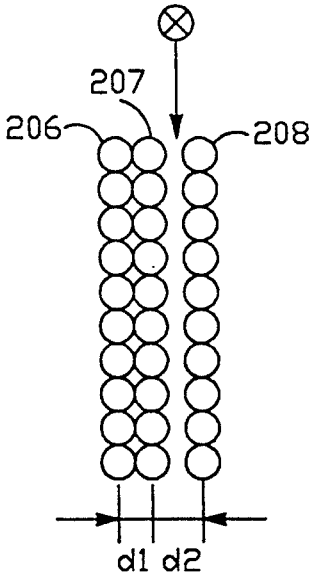
FIG.-21 (PRIOR ART)
FIG. 21 shows dot strings produced by a prior art tape printer which have a gap between dot strings.

FIG. 5(*a*) illustrates the tape printing process, where 58 is an editing buffer inside RAM 57 with character group 200 input in memory from the keyboard. Completion code 201 shows the end of the edit characters. Print buffer 60, stored inside RAM 57, as shown in FIG. 5(*a*), is memory that is used to convert the character codes in edit buffer 58 into bit-mapped representations of these characters. The conversion of the edit buffer data to the bit-mapped representation in print buffer 60 is accomplished using a print CG in ROM 51. Within print buffer 60, the presence or absence of dot data is shown respectively by 202, 203.

Printing, as shown in FIG. 5(*b*), is achieved by sending dot string data, or information, from the bit-mapped representations in print buffer 60 to thermal print head 105. By transmitting this information in sequence and driving thermal print head 105 in accordance with the transmitted information, the symbols representations in print buffer 60 are recreated (i.e. printed) on tape. FIG.

5(*b*) shows the printed dot strings transmitted to thermal print head 105 so as to form a portion of print character "A". Dots that do not print 204 and printed dots 205, are also shown in FIG. 5(*b*). Between the printing of each dot string, stepper motor 103 is driven to accomplish tape feeding. Distance D1 between dot strings is controlled by the rotational feed amount of tape feed roller 111 which is in turn regulated by the stepper motor drive control.

Figure 6:
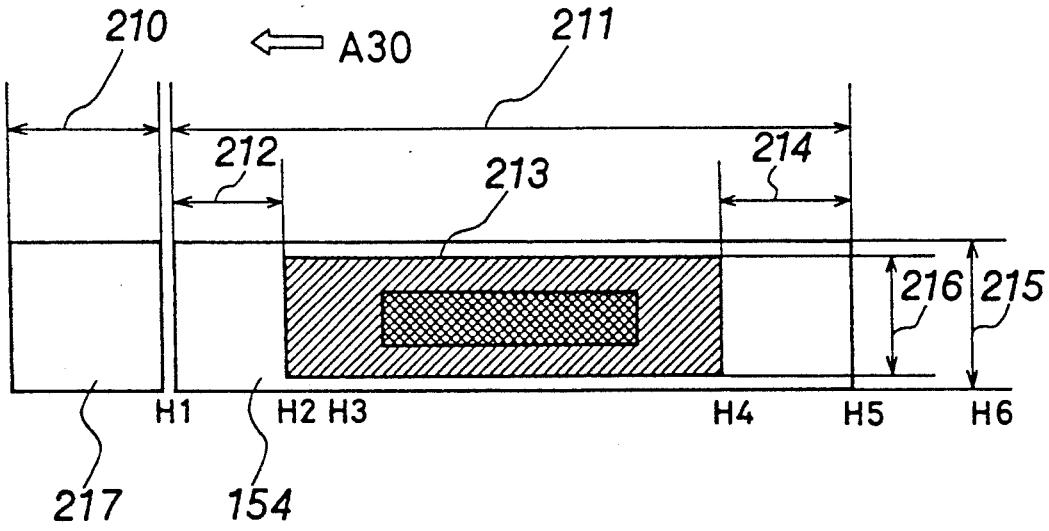
FIG. 6 illustrates various aspects of the printing tape used in the present invention such as lead margin, rear margin, and printing zone.

FIG. 6 is a diagram illustrating the relation between the head position and printing tape 154. Arrow A30 shows the tape feed direction. Blank tape 217, having a length substantially equal to the distance between the print head position and the cutter position. leads the printed portion. Tape length 211, is the sum of lead margin 212, printing zone 213 and rear margin 214. Tape width 215, and printing width 216 are also shown in FIG. 6.

Initially, thermal print head 105 is at position H1 relative to the tape. When a print command is received, the tape printer feeds a portion of tape equal in length to lead margin 212. When thermal print head 105 and the tape come to relative position H2, printing starts. When the tip of the lead margin comes to the cutter position after printing starts, (i.e. thermal print head 105 and tape in relative position H3), the printing process is suspended and the cutting process is performed.

After cutting, printing resumes and when printing is finished, thermal print head 105 and the tape are relatively positioned at H4. So after the head-to-cutter distance 210 portion of the tape has been advanced in order to obtain the printed tape piece, cutting is done (thermal print head 105 and the tape being relatively positioned at H6). Head-to-cutter distance portion 210 of the tape at this time is excess.

One method of preventing unwanted displacement between dots during cutting is hold control of the stepper motor and another method is reversing the tape before and after tape cutting.

Stepper Motor Hold Control

The hold control method is classified into a chopping control and a current limiting control. It is generally believed that chopping control is preferable to current limiting control because chopping control does not require additional hardware components and further because it can be easily implemented by means of software. On the other hand, chopping control produces both audible and electrical noise, and therefore which method to use must be decided on the basis of the requirements of each application.

Figure 7:
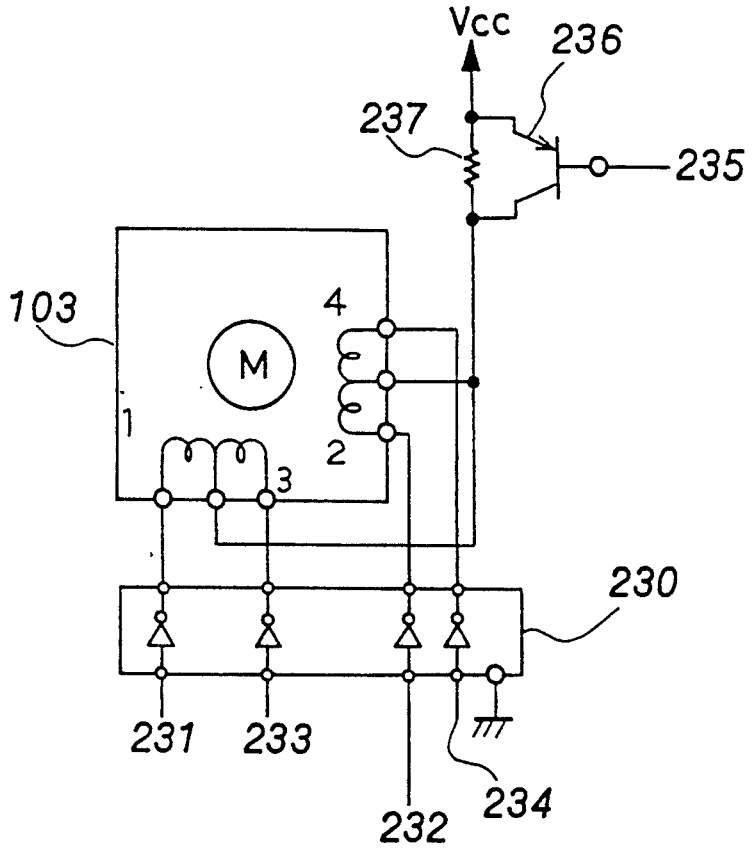
FIG. 7 is a circuit diagram of a tape feed motor of a tape printer according to the present invention.
Figure 8:
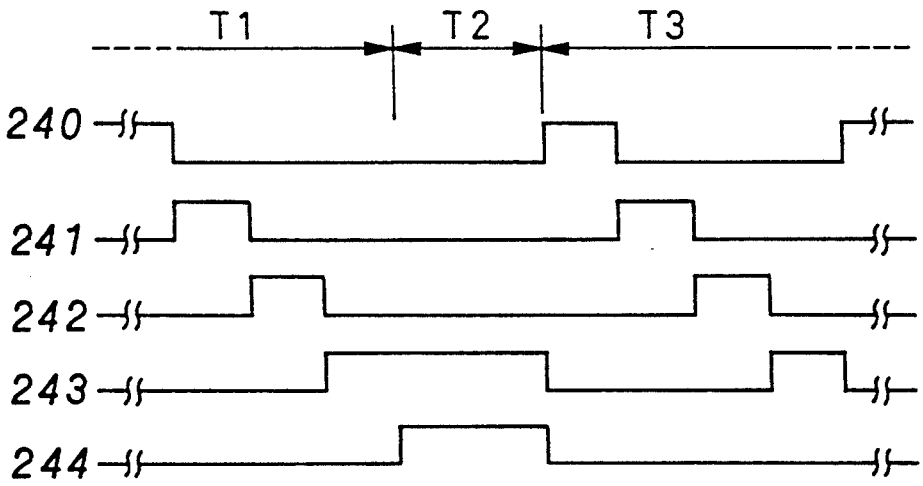
FIG. 8 is a control timing diagram of a tape feed motor for a tape printer according to the present invention.
Figure 9:
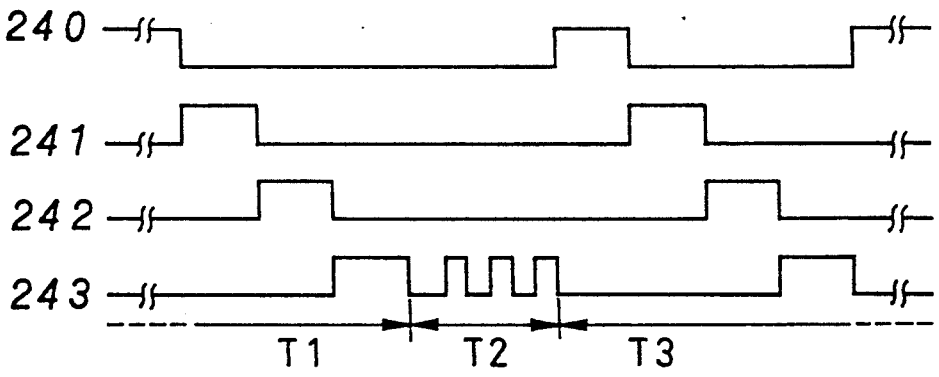
FIG. 9 is a control timing diagram of a tape feed motor for a tape printer according to the present invention.

FIG. 7 is shows a drive control circuit for a stepper motor. FIG. 8 is a timing diagram showing the drive method of the drive control circuit of FIG. 7. FIG. 9 is a timing diagram that realizes chopping control of the stepper motor.

The stepper motor drive control circuit uses a current limiting circuit having a current limiting resistance 237, and a transistor 236 that shunts large currents around current limiting resistance 237. When a hold signal is asserted and applied to terminal 235 of transistor 236, transistor 236 goes to an OFF state and current flows through current limiting resistance 237. When the hold signal applied to terminal 235 is deasserted, transistor 236 goes to an ON state and a large current flows. In this manner the rotation of the stepper motor is suspended and it goes to a hold state. Stepper motor driver 230, is shown in FIG. 7, as are phase 1 231, phase 2 232, phase 3 233, and phase 4 234 terminals of the stepper motor driver 230.

In FIG. 8, the respective phase 1 240, phase 2 241, phase 3 242 and phase 4 243 timing signals of the stepper motor, and hold signal 244 are shown. Time slices T1 and T3 are the rotation control sections of the stepper motor, and section T2 is the hold control time slice. As shown in FIG. 7, with hold signal 244 at a HIGH state (time slice T2) transistor 236 goes to an OFF state and stepper motor 103 is on hold. In time slice T2 cutting of the printed tape is done. Hold control signal 244 is asserted synchronously with phase 4 timing signal 243 such that phase 4 is also asserted, as shown in FIG. 8.

FIG. 9 illustrates an alternative embodiment where hold control of the stepper motor is realized by controlling an excitation phase drive signal intermittently with the so-called chopping control. The drive control circuit has current limiting resistance 237 and transistor 236 excised from FIG. 7. T1 and T3 are rotation control time slices, and T2 is a hold control time slice. In FIG. 9, phase 1 240, phase 2 241, phase 3 242 and phase 4 243 are the timing signals of the stepped motor.

Tape Reversal Method

Figure 10:
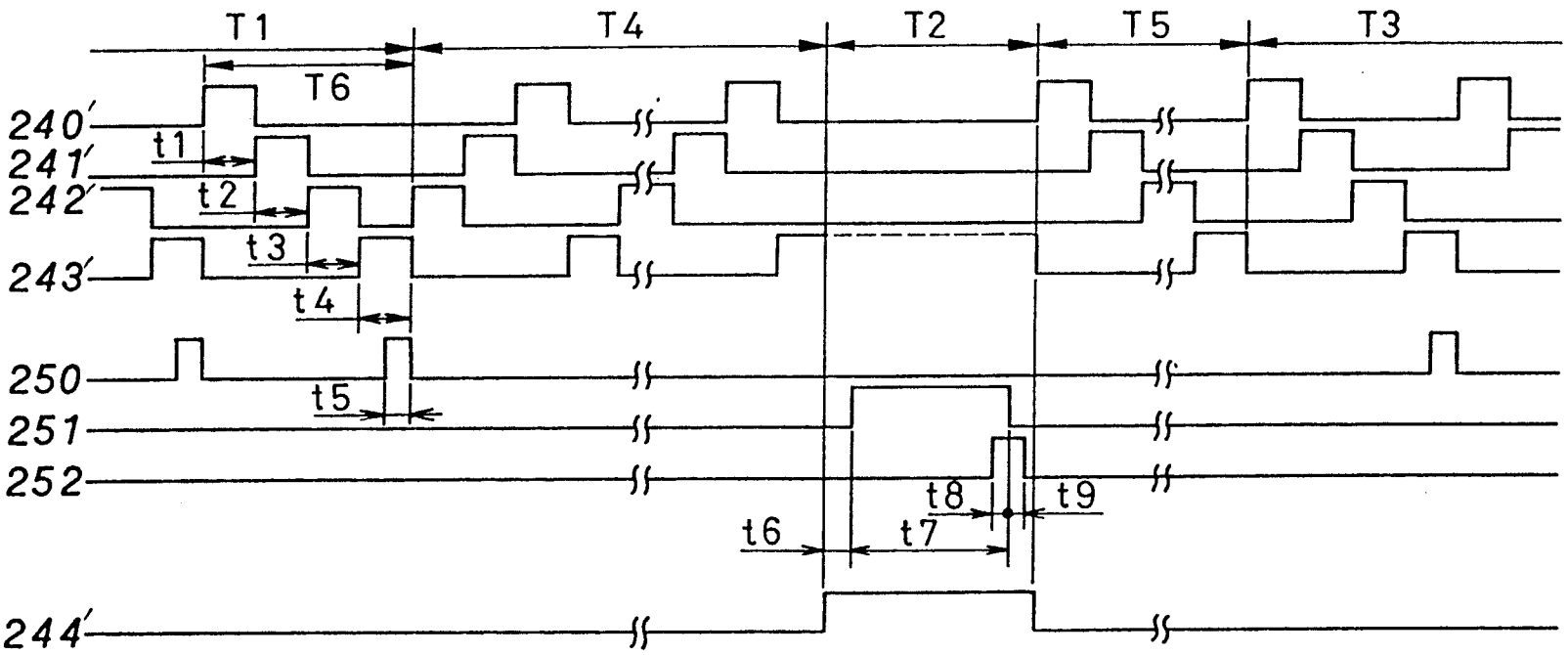
FIG. 10 is a control timing diagram for cutting control in a tape printer according to the present invention.

FIG. 10 is a timing diagram for reversing and forwarding the tape transport mechanism (i.e. tape feed) before and after tape cutting. More specifically FIG. 10 shows phase 1 240', phase 2 241', phase 3 242' and phase 4 243' drive signals of stepper motor 103, head current signal 250, cutter starting signal 251, cutter home sensor detection signal 252, head hold signal 244'.

In time slice T1, the conventional tape feeding (t1, t2, t3, t4) and current passage (t5) are done. T6 shows the tape feed time of one dot string. Tape feeding is reversed when it comes to the cutting position (T4), and tape cutting is done (T2). The tape is then forwarded so that it returns to the position it had before cutting (T5). Tape feeding and printing are then resumed (T3). During tape cutting, the stepper motor is held by stepper motor hold signal 244'. DC motor 146 that drives the cutter in this interval starts by means of cutter drive signal 251. Since the signal showing that the cut has been completed is output as home position detection signal 252 from cutter home detector 159, cut drive signal 251 is deasserted when cutter home detection signal 252 is detected. Then hold signal 244' is deasserted and the printing operation resumes.

In FIG. 10, t1, t2, t3 and t4 respectively show drive pulse times of phase 1, phase 2, phase 3 and phase 4 of stepper motor 103, t5 shows the active time of print head 105, t7 the drive time of the cutter, t8 and t9 the pulse time of the cutter detector, and t6 the time after tape reversal until the power supply stabilizes and the cutter is driven.

Figure 11:
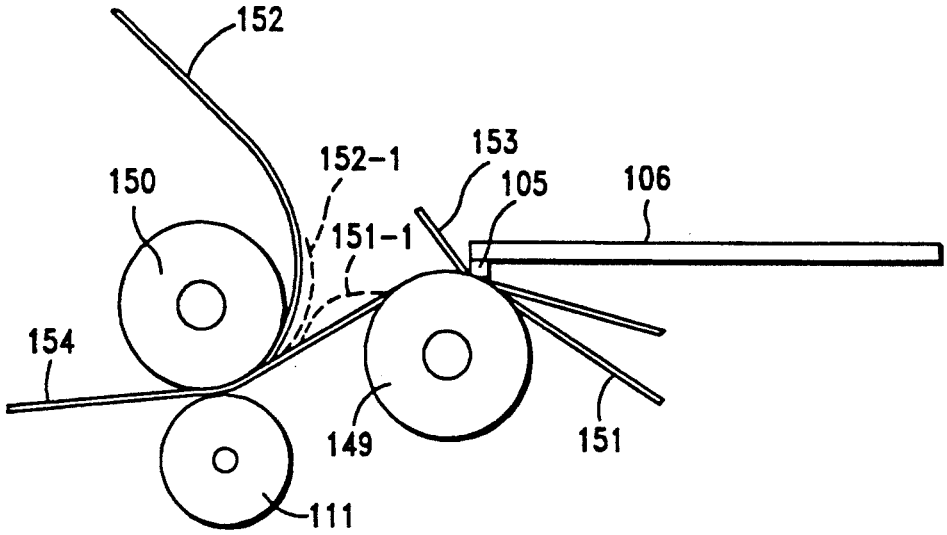
FIG. 11 shows the tape during cutting control in a tape printer according to the present invention.

FIG. 11 shows the state of the double sided adhesive tape and the transparent tape at time of tape cutting. Double sided adhesive tape 152 and transparent tape 151 are stretched by the tensile force of conventional tape feed-out, but respectively reach slackened states as shown by 152-1 and 151-1 because of the reversal of tape feed. At this time transparent tape 151 and ink ribbon 153 are held under pressure between thermal print head 105 and platen roller 149 and therefore do not move. When the tape is cut, double sided adhesive tape 152-1 and transparent tape 151-1 are stretched by the cutting and are fed somewhat, but transparent tape 151 and ink ribbon 153 are held under pressure between thermal print head 105 and platen roller 149 and therefore do not move. After tape cutting the tape is fed forward, and double sided adhesive tape 152-1 and transparent tape 151-1 return to their stretched state. Control is done so that there is no stretching out to an excess portion because tape forwarding is with a stepper motor pulse number smaller than the number used for reversing.

Figure 12A:
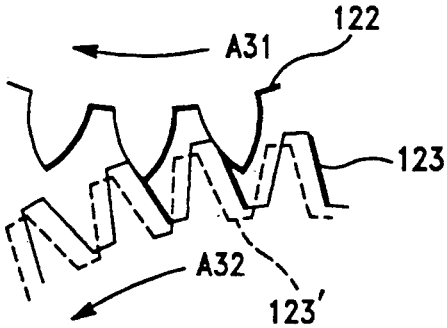
FIG. 12(*a*)–(*b*) show the gears during cutting control in a tape printer according to the present invention.
Figure 12B:
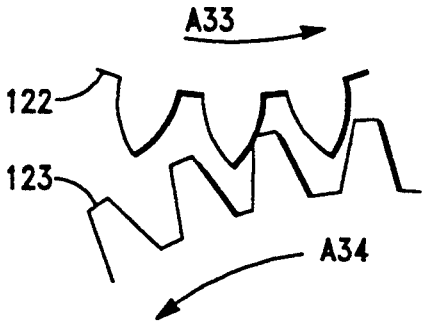

The effectiveness of the reversal can be seen in FIGS. 12(*a*) and (*b*) which show the engaging portions of stepper motor gear 122 and transmission gear 123. FIG. 12(*a*) shows the suspended state during conventional tape feeding and FIG. 12(*b*) the suspended state during reversal. In FIG. 12(*a*) when rotation is in the direction of arrow A31, the tape is fed out. When the cutting operation is done in this state, the tape is pulled in the direction of arrow A32 and the transmission gear ends up moving as shown by broken line 123'. In this invention the tape moves in the reverse direction of arrow A33, shown in FIG. 12(*b*), and transmission gear 123 cannot move even if pulled in the direction of arrow A34 by the action of the cutter at this time. As explained above, if the motor is not moved in the reverse direction at prescribed steps, it is easy for the tape to be pulled out during cutting, and also a backlash of the gears occurs relative to gears 125, 127, 128 associated with tape feeding, and in that case the backlash amount is accumulated.

Control Algorithms

Figure 13:
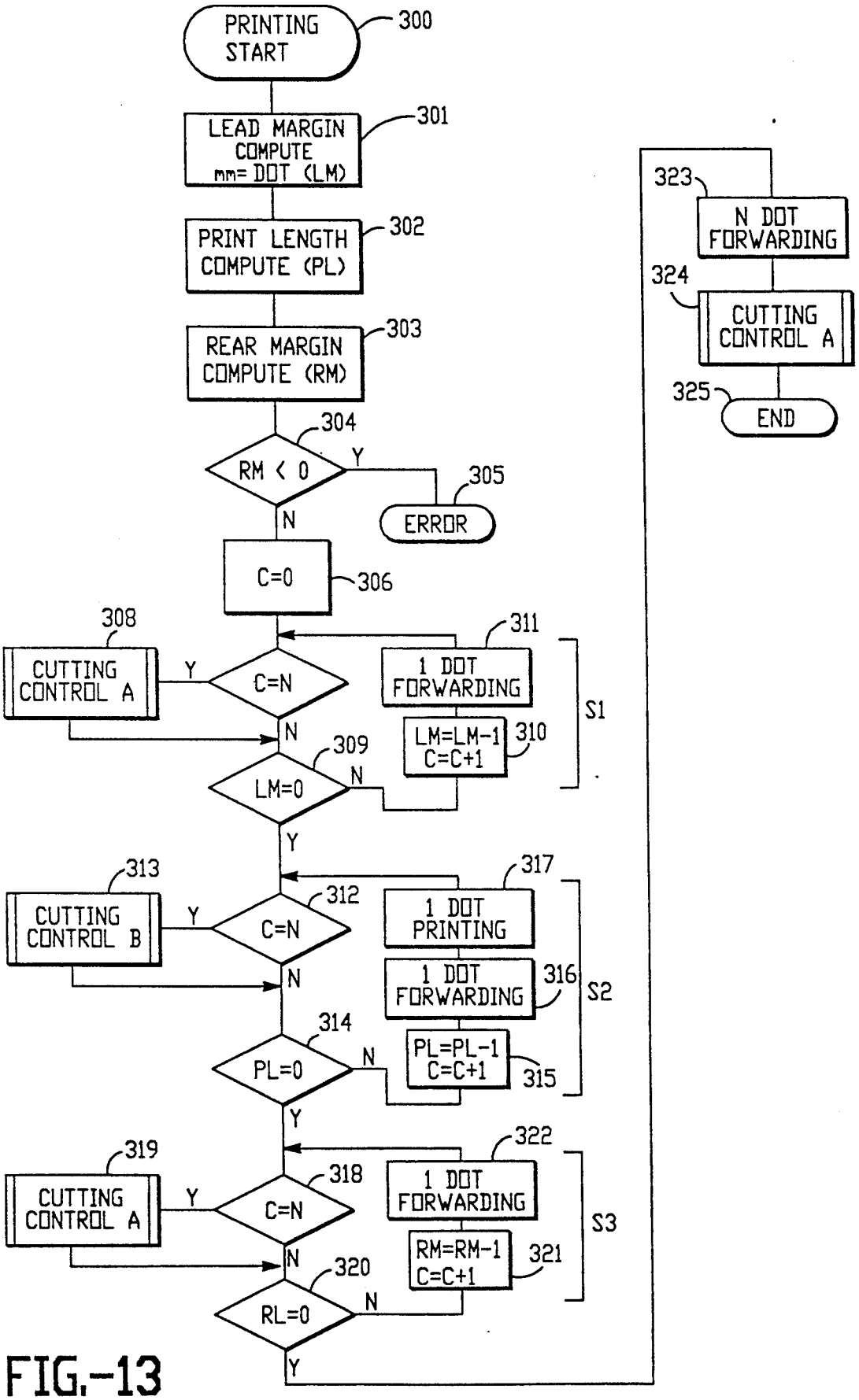
FIG. 13 is a flowchart showing the general cutting control algorithm for a tape printer according to the present invention.
Figure 15:
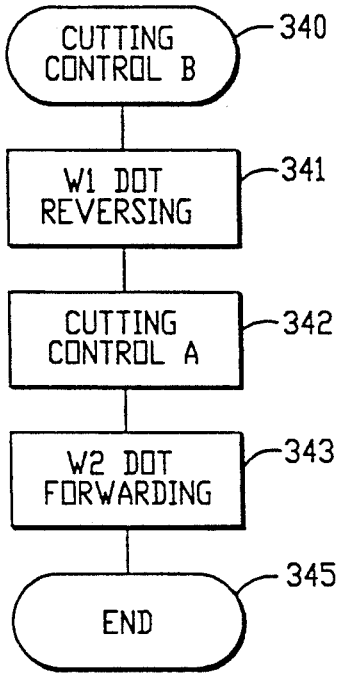
FIG. 15 is a flowchart showing details of the cutting control algorithm for a tape printer according to the present invention.
Figure 14:
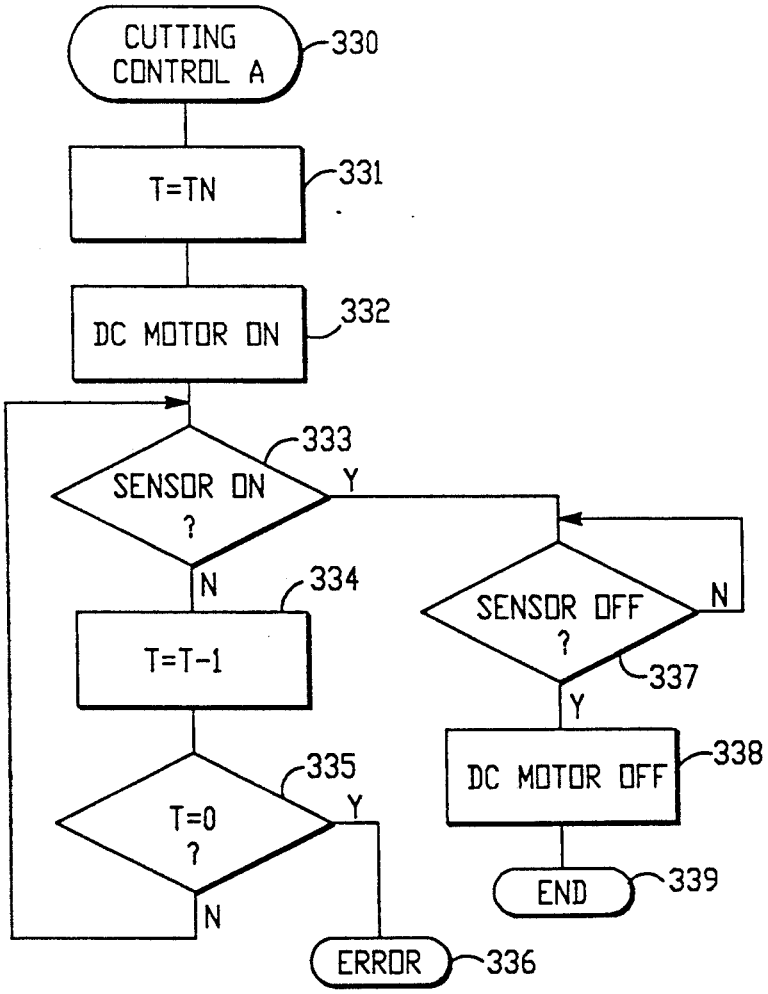
FIG. 14 is a flowchart showing details of the cutting control algorithm for a tape printer according to the present invention.

FIGS. 13–15 are control flowcharts that show the reversal at time of tape cutting.

In FIG. 13, LM represents lead margin, PL represents printing length, RM represents rear margin and C represents dot count of the tape feed. N represents the number of dots which equal the distance from print head to cutter. These variables are stored in work region 61 of RAM 57. In one embodiment of the invention, one dot equal four steps of the stepper motor.

When the printing process starts (step 300), the lead margin LM is computed from the lead margin setting value LMGN 68 in RAM 57. This computation converts millimeters to dots (step 301).

$$LM = LMGN\ (mm)/d1$$

(d1 is the distance between tape feed dots, see FIG. 5.)

Next print length PL is computed. Print length PL is computed by print character width WIDE 64, and the number of characters and the space between characters CSPC 66, (step 302).

$$PL = (WIDE * \text{number of characters}) + (CSPC * (\text{number of characters} - 1))$$

Next rear margin RM is computed. Rear margin RM can be obtained by subtracting lead margin LM and print length PL from tape length setting TLNG 67, (step 303).

$$RM = TLNG - LM - PL$$

If the computed rear margin RM is negative, it is taken as an error (steps 304, 305).

Tape feed dot counter C is initialized to zero (step 306).

First, lead margin feeding operation S1 is done. That is, LM is decremented by one with each one dot feeding (step 311) until LM becomes zero (step 309). Counter C is incremented by one with each on dot feeding (step 310). Whether the value of C at this time has come to the cutting position is determined by comparing C and N (step 307). When it has come to the cutting position, cutting control algorithm A is used (FIG. 14).

Printing operation S2 (steps 312 to 317) is similar to lead margin feeding operation S1. The printing operation differs from the lead margin feeding operation in that: a) the printing of one dot string is done with each one dot feed (step 317), and b) cutting control algorithm B is utilized (step 313). Cutting control algorithm B and cutting control algorithm A differ in that cutting control algorithm B includes pre-cutting tape reversal and post-cutting tape forwarding.

Rear margin tape feed (S3) is done in the same manner as the lead margin (steps 318 - 322).

As can be seen from FIG. 13, the arrival of the tape at the cutting position (i.e. when C=N) necessarily occurs once for each of front margin tape feed, printing tape feed and rear margin tape feed, cutting is done at any one place among cutting control steps 308, 313 and 319. Tape cutting is done after the rear margin tape feed. After tape feeding of N dots has been done (step 323), cutting control algorithm A is performed (step 324) and printing control terminates (step 325).

FIG. 14 is a flowchart of cutting control algorithm A (when not in reverse). T is a timer internal to CPU 50 (not illustrated) and TN is the time-out time of the cutter. First the time-out time TN of timer T is set (step 331). Then DC motor 146, that drives the cutter, is started (step 332). Timer T is decremented by 1 (step 334) until the signal of cutter home sensor 159 is asserted (step 333), and when timer T becomes zero a time-out is discriminated (step 335) and is taken as a cutter operation error (step 336). When cutter home sensor 159 becomes ON before time-out, after sensor 159 goes OFF (step 337) the DC motor operation is suspended (step 338) and the cutting control algorithm A process is complete (step 339).

FIG. 15 is a flow chart for cutting control algorithm B (i.e. tape feed reversal). W1 is the reverse step number, W2 is the forward step number. W1 and W2 are determined experimentally. The tape length equivalent of W1 steps backward (i.e. in the reverse direction) should be greater than the amount of back-lash of the gears 122, 123, 127 and 128, plus an amount sufficient to create slack (or sag) in the tape. W2 is less than or equal to W1 because the tape is occasionally pulled a little bit in the forward direction by the cutter even if the stepper motor is controlled so as to hold the tape in a fixed position.

In cutting control algorithm B, before calling cutting control algorithm A (step 342) reverse feeding of a W1 dot long portion of tape is done (step 341), and after cutting control algorithm A is executed, forwarding of a W2 dot long portion of tape is done (step 343).

Figure 22:
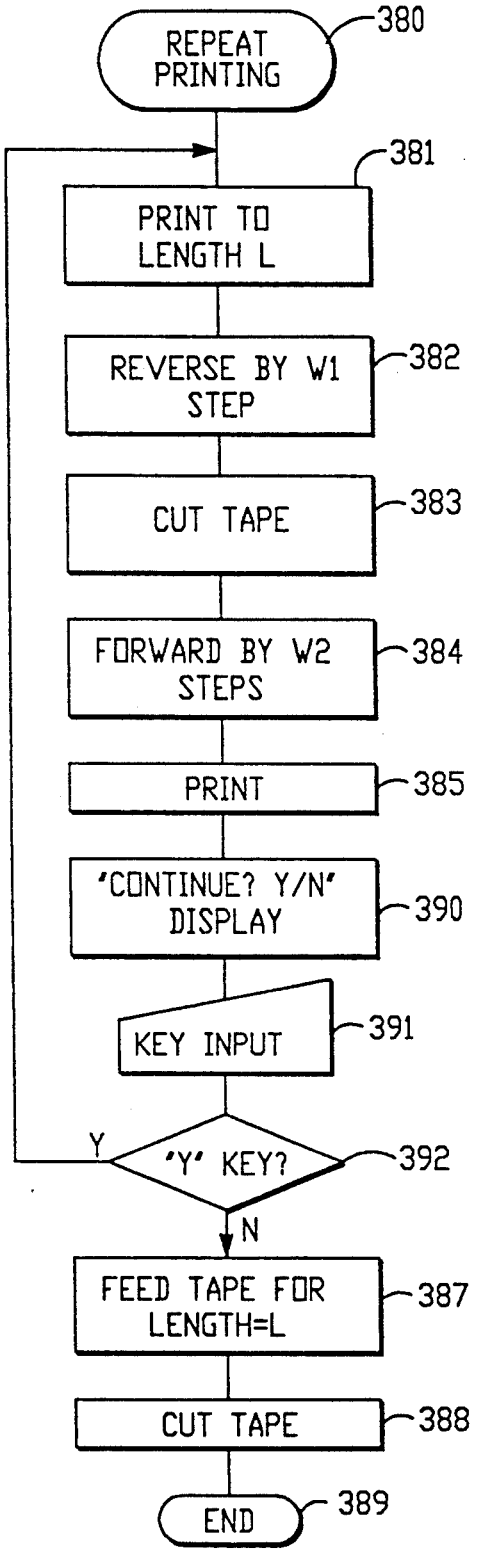
FIG. 22 is a flowchart showing a tape printer control algorithm of the present invention.

FIG. 22 is a flow chart showing a control process for the tape printer of the present invention. The printing process is begun and continues until the tape has been advanced an amount substantially equal to L (i.e. the distance between the printing position and the tape cutting position (step 381). At this point, the printing process is suspended and the tape transparent mechanism is operated such that the tape is reversed, or moved back an amount equal to W1 steps (step 382). Next the tape is cut by the tape cutting means (step 383). Following the cutting step, the tape transport mechanism is operated such that the tape is advanced by W2 steps (step 384). Printing is then resumed (step 385).

When printing of a particular character or graphics string is complete, the user is queried as to whether to repeat the printing process. The interaction between printer and user takes place by means of display unit 15 and keyboard 20. For example, this interaction may take place as follows:

Printer display unit 15 displays "Continue? (Y/N)". At this point the printer waits to receive input from keyboard 20 (step 391). When character input from keyboard 20 is detected, a determination is made as whether to repeat the printing process. If the entered character is "Y" then the printing process is repeated. If the entered character is "N" then the tape is advanced by an amount substantially equal to length L (step 387) and the tape is cut (step 388). If a number is entered rather than "Y" or "N" then the printing process is repeated for a number of times equal to the number entered.

Lead Margin and Tape Length Setting Means

Figure 16:
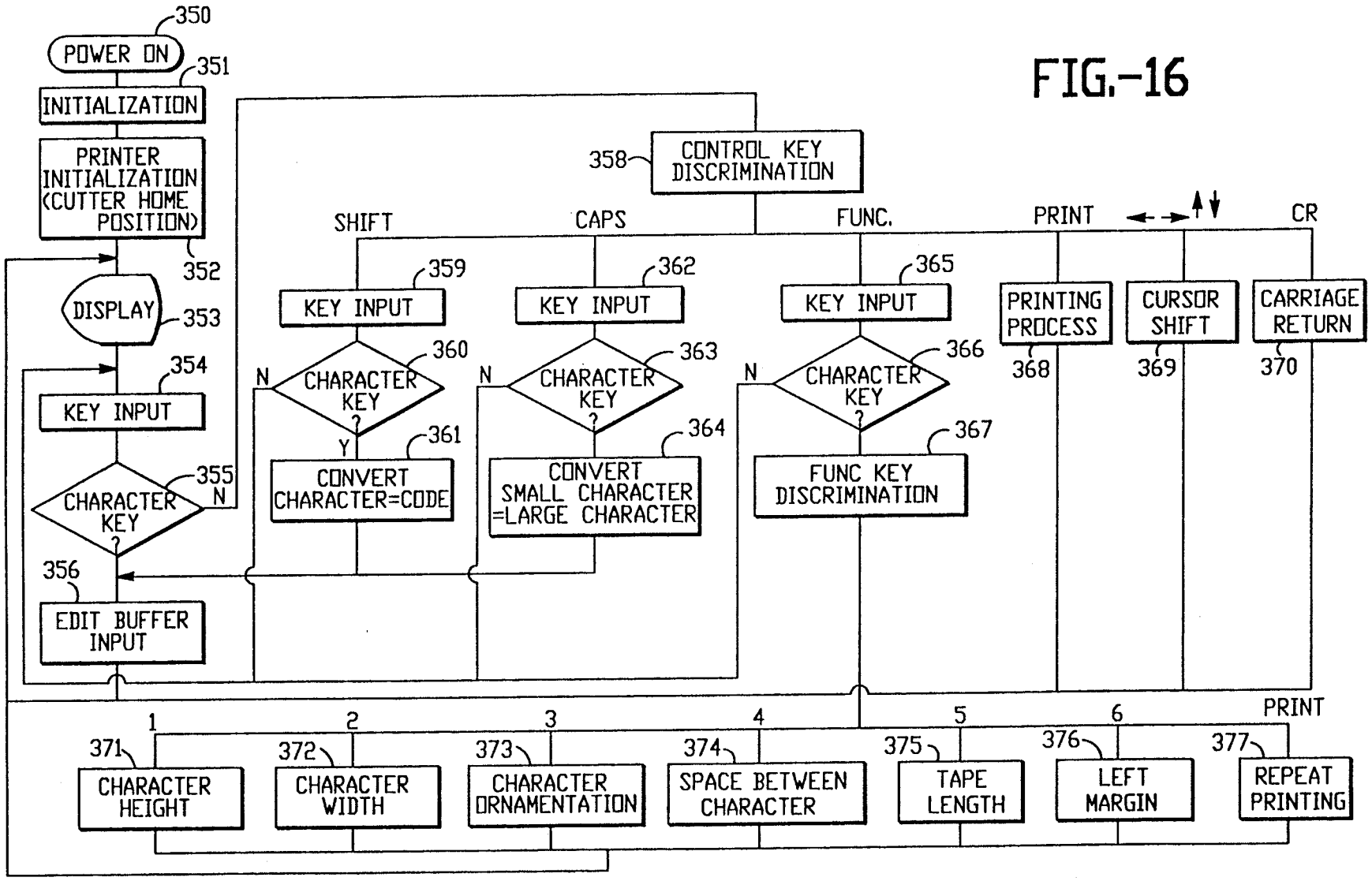
FIG. 16 is a flowchart showing the main control algorithm for a tape printer according to the present invention.

FIG. 16 shows the main control flow of the inventive tape printer. With the power supply ON (step 350), system initialization (step 351) is done. Then initialization of the printer mechanism portion is done (step 352). With the initialization of the printer mechanism the cutter shifts to its home position. Next, the characters of edit buffer 58 are displayed (step 353), and key input waiting is done (step 354). If the keyboard input is a character key (step 355) then the corresponding character code is transmitted to, and stored in, edit buffer 58 (step 356). If the keyboard input is not a character key, then control key discrimination is done (step 358) and an operation associated with that control key is performed.

With the SHIFT key and CAPS key input waiting is done for the next character (steps 359, 362), and when the keyboard input is a character key (steps 360, 363) it converts respectively to a code or large character (steps 361, 364) and is input to the edit buffer. If it is not a character key, that keystroke is disregarded and input waiting is done for the next key (step 354).

If a FUNC key input is detected then waiting is done for the next keystroke (step 365), and if that key is a character key (step 366) function key discrimination is done (step 367) and the associated function is carried out.

With respect to function key discrimination in the preferred embodiment, when the input key is a 1, 2, 3, 4, 5 or 6 numeric key, the respective actions taken are: character heights are set (step 371), character width setting (step 372), character ornamentation setting (step 373), space between character setting (step 374), tape length setting (step 375) or lead margin setting (step 376). If it is a print command key, repeat printing is done (step 377). In control key discrimination (step 358), if it is a print command key, printing is done (step 368), if it is a cursor key, cursor shifting is done (step 369) and if it is a carrier return key then a carrier return operation is done (step 370).

In tape length setting (step 375) and lead margin setting (step 376), the presently set values are displayed in units of millimeters on display unit 15, and these numeric values can be raised or lowered with the cursor key, alternatively the numeric values can be input directly from the keyboard via the numeric keys. The numeric values are then entered by hitting the return key. A rear margin setting means is unnecessary because as long as there is a tape length setting means and a lead margin setting means and a character width setting means and a space between characters setting means, the rear margin is automatically determined. Repeat printing (step 377) is the same as in the foregoing description.

FIGS. 17(*a*)-(*f*) illustrate the label making process in a tape printer according to the present invention. In this example, the production of a tape piece (i.e. label) printed with the character string "ABC" is shown.

P1 represents the position of thermal print head 105, P2 represents the position of the cutting blade, and L represents the distance between print head and cutter. FIG. 17(*a*) shows the state of the tape before printing begins. The printing process comprises tape feeding and dot string printing. When the tape has been fed an amount substantially equal to length L, tape feeding and printing are suspended. At this point the excess portion of tape is cut off, leaving the tape in the condition shown in FIG. 17(*c*). After the tape has been cut, printing and tape feeding resume. FIG. 17(*d*) shows the state where printing is completed.

When the tape piece is to be output without printing again (i.e. when the printing operation is ended) tape is fed by an amount substantially equal to L. Tape cutting is done as shown in FIG. 17(*f*), and a tape piece printed with "ABC" and without any excess portion, is output.

By contrast, when the printing operation is to be continued, printing is started again while the tape is as shown in FIG. 17(*d*). When the tape has been fed by an amount substantially equal to length L, the printing process is suspended (FIG. 17(*e*)). Tape cutting is done in this state and a tape piece printed with "ABC" is cut off. After the tape has been cut, the printing process resumes.

When continuously outputting tape pieces printed with "ABC" in this manner, the operations in FIGS. 17(*a*) and (*b*) are done first, and then operations shown FIGS. 17(*c*), (*d*) and (*e*) are repeated. Excess tape of substantially length L (slanted line portion in FIG. 17(*b*)) is produced only initially, and the multiple tape pieces to be output will include no excess portions.

Figure 18:
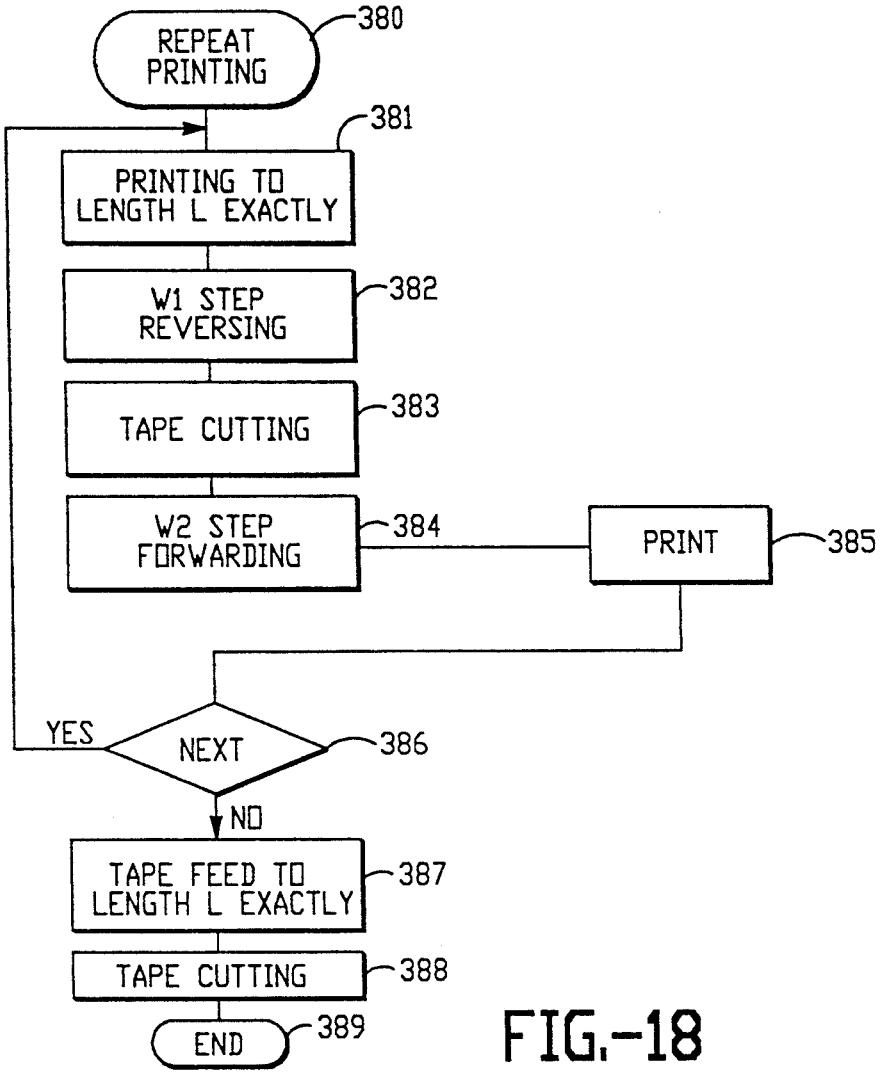
FIG. 18 is a flowchart showing the cutting control in a tape printer according to the present invention.
Figure 20:
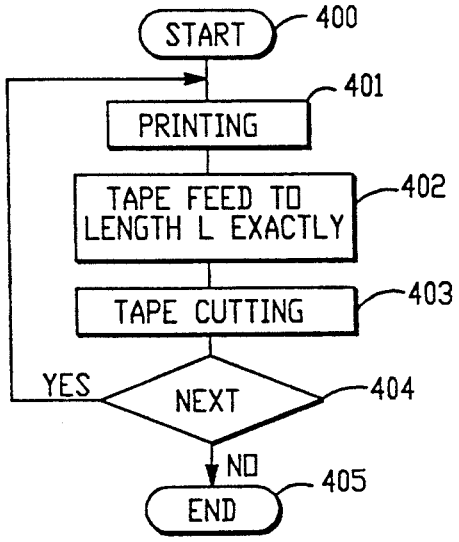
FIG.-20 (PRIOR ART)
FIG. 20 is a flowchart illustrating the tape label making process of prior art tape printer.

FIG. 18 is a flowchart of the label making process illustrated in FIGS. 17(*a*-(*f*). At the very beginning printing is done on the tape substantially to length L (the distance between the printing position and the tape cutting position) (step 381). At this point printing is interrupted and the tape is reversed by W1 steps (step 382). After performing tape cutting (step 383), the tape is forwarded by W2 steps (step 384), and the printing process (step 385) is resumed.

When printing is completed a decision is made whether print again (step 386). If an affirmative decision is made that printing is to be carried out, then printing is resumed (step 381) as shown in FIG. 18. If a negative decision is made that no printing is to be carried out, the tape is fed an amount substantially equal to length L (step 387), cutting (step 388) is done and the process ends (step 389). The decision at step 386 may also be answered by user inquiry and responses, or the user may set the number of repetitions just prior to repeat printing so that the tape printer may countdown and stop printing automatically.

Further, although explanation was made in the present example of the case where a tape piece printed with "ABC" was continuously output, there is nothing to prevent continuous printing with the printed characters, or graphics, being changed for each tape piece.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the subjoined claims.

What is claimed is:

1. A tape printer comprising:
a) a frame;
b) a means for tape transport mounted on said frame;
c) a means for cutting tape mounted on said frame;
d) a means for controlling said tape transport means, coupled to said tape transport means, operable to feed tape in both the forward and reverse directions;
e) a means for controlling said cutting means, coupled to said cutting means;
f) a means for setting total tape length coupled to said means for controlling said tape transport means;
g) a means for setting lead margin length coupled to said means for controlling said tape transport means;
h) a means for setting character space length coupled to said means for controlling said tape transport means; and
i) a means for computing rear margin length coupled to said means for controlling said tape transport means.

2. The tape printer of claim 1, wherein said tape transport means includes a motor as the drive source of said tape transport means.

3. The tape printer of claim 2, wherein said motor is a stepper motor.

4. The tape printer of claim 1 further comprising:
a) a display unit, mounted on said frame, for communicating with an operator; and
b) an input means, coupled to said tape printer, for communicating with said operator.

5. The tape printer of claim 4 wherein said display unit comprises a liquid crystal display.

6. The tape printer of claim 4 wherein said input means comprises a keyboard.

7. The tape printer of claim 1 wherein said means for setting total tape length, said means for setting lead margin length, and said means for setting character space length, comprise a programmed data processor.

8. The tape printer of claim 7 wherein said programmed data processor comprises a single-chip microcomputer.

9. The tape printer of claim 7 wherein said means for setting total tape length, said means for setting lead margin length, and said means for setting character space length further comprise a means for inputting data.

10. The tape printer of claim 9 wherein said means for inputting data is a keyboard.

11. A method of controlling a printer which prints on tape, comprising the steps of:
a) beginning a printing process comprising the steps of (i) printing a dot string on said tape, (ii) advancing said tape by means of a tape transport mechanism, and (iii) repeating steps (i) and (ii);
b) suspending said printing process;
c) operating said tape transport mechanism in a reverse direction so that slack is created in said tape;
d) cutting said tape at a predetermined position after step (c);
e) operating said tape transport mechanism in a forward direction to advance said tape by an amount less than or equal to the amount reversed in step (c); and
f) resuming said printing process.

12. A method of controlling a printer which prints on tape, said printer having a tape transport mechanism and an edit buffer, comprising the steps of:
a) creating a bit-mapped representation of said edit buffer contents;
b) beginning a printing process comprising the steps of (i) printing a dot string on said tape, (ii) advancing said tape by means of said tape transport mechanism, and (iii) repeating steps (i) and (ii);
c) suspending said printing process;
d) operating said tape transport mechanism in a reverse direction so that slack is created in said tape;
e) cutting said tape at a predetermined position;
f) operating said tape transport mechanism in a forward direction to advance said tape by an amount less than or equal to the amount reversed in step (d);
g) resuming said printing process;
h) stopping said printing process when said bit-mapped representation of said edit buffer contents have been printed;
i) displaying an input request message on a display unit; and
j) receiving input in response to said input request message via an input means.

13. The method of claim 12 further comprising the steps of:
a) evaluating said input from said keyboard;
b) ending said printing process if the character 37 N" has been received;
c) repeating said printing process once if the character "Y" has been received; and
d) repeating said printing process X times, where X is an integer number, if integer number X has been received.

14. The method of claim 12 wherein said step of creating a bit-mapped representation of said edit buffer contents includes the use of a character generator memory.

15. The method of claim 12 wherein said input means is a keyboard.

16. The method of claim 14 wherein said character generator memory is a Read Only Memory.

17. The method of claim 14 further comprising the step of selecting character generator memory regions corresponding to user selected fonts and styles for creating a bit-mapped representation of input data.

18. A method of controlling a printer which prints on tape, comprising the steps of:
a) beginning a printing process comprising the steps of (i) printing a dot string on said tape, (ii) advancing said tape by means of a tape transport mechanism, said tape transport mechanism including a stepper motor, and (iii) repeating, at least once, steps (i) and (ii);
b) suspending said printing process;
c) operating said stepper motor to achieve hold control such that said tape is substantially prevented from advancing or reversing; and
d) cutting said tape after step (c).

19. A method of controlling a printer which prints on tape, comprising the steps of a) beginning a printing process comprising the steps of (i) printing a dot string on said tape, (ii) advancing said tape by means of a tape transport mechanism, said tape transport mechanism including a stepper motor, and (iii) repeating, at least once, steps (i) and (ii);

b) suspending said printing process;

c) operating said stepper motor to achieve hold control such that said tape is substantially prevented from advancing or reversing; and d) cutting said tape after step (c); and e) operating said tape transport mechanism in a reverse direction so that slack is created in said tape prior to operating said stepper motor to achieve hold control.

20. The method of claim 19 wherein said step of operating said stepper motor comprises controlling an excitation phase drive signal intermittently.

21. The method of claim 19 wherein said step of operating said stepper motor comprises current limiting by turning off a current shunt transistor.

22. A method of controlling a printer which prints on tape, comprising the steps of a) receiving total tape length for a printing process from an input means;

b) receiving lead margin length for said printing process from said input means;

c) receiving character space length for said printing process from said input means;

d) computing rear margin length for said printing process; and e) automatically operating said printer such that tape is advanced before and after printing on said tape and f) beginning a printing process comprising the steps of (i) printing a dot string on said tape, (ii) advancing said tape by means of a tape transport mechanism, said tape transport mechanism including a stepper motor, and (iii) repeating, at least once, steps (i) and (ii);

g) suspending said printing process;

h) operating said stepper motor to achieve hold control such that said tape is substantially prevented from advancing or reversing; and i) cutting said tape,

23. The method of claim 22 wherein said input means comprises a keyboard coupled to a programmed data processor so as to be in communication with said programmed data processor.

* * * * *